US006640464B2

(12) United States Patent
Hsin et al.

(10) Patent No.: US 6,640,464 B2
(45) Date of Patent: Nov. 4, 2003

(54) SANDAL WITH INTERCHANGEABLE UPPER AND SOLE

(76) Inventors: Harry Hsin, D Room, 5F, No. 116, Tai Tun 20 St., Taichung (TW); Kung-Sheng Pan, 7F, No. 19-28, Chung Yung Rd., Nan Tun Area, Taichung (TW)

( * ) Notice: Subject to any disclaimer, the term of this patent is extended or adjusted under 35 U.S.C. 154(b) by 0 days.

(21) Appl. No.: 09/901,030

(22) Filed: Jul. 10, 2001

(65) Prior Publication Data

US 2002/0124434 A1 Sep. 12, 2002

(30) Foreign Application Priority Data

Mar. 12, 2001 (TW) ..... 90203619 U

(51) Int. Cl.[7] ..... A43B 3/12; A43B 3/24
(52) U.S. Cl. ..... 36/11.5; 36/101; 36/50.1
(58) Field of Search ..... 36/50.1, 50.5, 36/11.5, 101

(56) References Cited

U.S. PATENT DOCUMENTS 2,607,133 A * 8/1952 Marlowe ..... 36/11.5
3,296,667 A * 1/1967 Streule et al. ..... 36/50.1
3,698,107 A * 10/1972 Fukuoka ..... 36/11.5
4,172,330 A * 10/1979 Kao ..... 36/11.5
5,848,457 A * 12/1998 Silagy ..... 36/50.1

FOREIGN PATENT DOCUMENTS

EP 551881 A1 * 7/1993
FR 2246163 * 5/1975

* cited by examiner

*Primary Examiner*—Ted Kavanaugh
(74) *Attorney, Agent, or Firm*—Browdy and Neimark, P.L.L.C.

(57) ABSTRACT

A sandal comprises a sole and at least one upper. The sole is provided in left and right sides with a connection piece. A stop member is fastened with the connection piece. The upper is provided at two ends with a connection hole for connecting the stop member. The connection piece of the sole may be provided with a hooked member which is fastened therewith fixedly or detachably. The hooked member has a neck. The upper is provided with a connection hole and a fitting hole in communication with the connection hole. The neck of the hooked member is retained in the connection hole of the upper. The upper or heel strap is detachably fastened with the sole.

12 Claims, 5 Drawing Sheets

SANDAL WITH INTERCHANGEABLE UPPER AND SOLE

FIELD OF THE INVENTION

The present invention relates generally to a footwear, and more particularly to a sandal with interchangeable upper and sole.

BACKGROUND OF THE INVENTION

The conventional sandal is formed of a sole and an upper which is fixed with the sole by sewing or adhesive.

In order to provide the consumer with a variety of shoes to choose from, the shoe makers must produce shoes of various sizes in quantity, thereby resulting in a substantial inventory cost. These conventional shoes are generally formed of an upper and a sole, which are made of different materials and are often not recyclable, thereby resulting in waste of the material resource as well as the environmental problem.

Certain conventional shoes are now formed of interchangeable upper and sole; nevertheless they are complicated in construction and are not cost-effective.

SUMMARY OF THE INVENTION

It is the primary objective of the present invention to provide a sandal which is versatile in design and having interchangeable sole and upper.

It is another objective of the present invention to provide a sandal with sole and upper which can be easily assembled or replaced.

It is still another objective of the present invention to provide a sandal with interchangeable and recyclable sole and upper easily.

In keeping with the principle of the present invention, the foregoing objectives of the present invention are attained by a sandal comprising a sole and an upper. The sole is provided in left and right sides with a connection piece and a stop member connected with the connection piece. The upper is provided at two ends with a connection hole for connecting the stop member. A hooked member is detachably fastened with the connection piece. Another upper is provided with a connection hole and a fitting hole for fitting the hooked member such that a neck of the hooked member is retained in the connection hole of the upper.

DETAILED DESCRIPTION OF THE INVENTION

Figure 1:
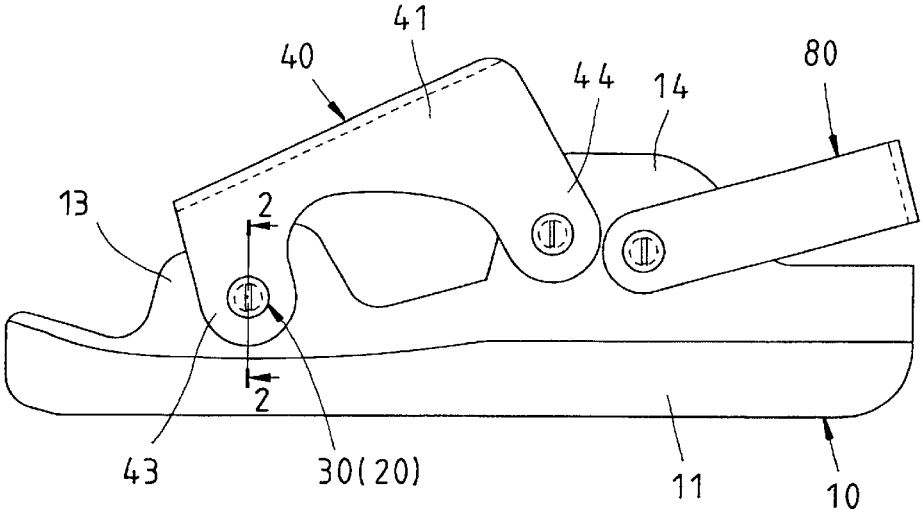
FIG. 1 is a side view of a preferred embodiment of the present invention in combination to show the state of the upper and the heel strap.

As shown in FIGS. 1–4, a sandal embodied in the present invention comprises the following component parts.

A sole 10 has a foot shape, a predetermined thickness, and a block body 11 which is provided at the front end of left side and right side with a connection piece 13, and in two sides of rear portion of midsegment with a connection piece 14 and a disposition hole 15 which is provided in opposite inner sides with a cavity 19 of a greater diameter.

A plurality of fastening members 20 are provided with a stop tray 21 and a fastening portion 23 which is provided with a threaded hole 25 and a plurality of grooves 27.

A plurality of stop members 30 have a turning portion 3 1which is provided at one end with a threaded rod 33 and a shoulder 35 separated from the outer side of the connection piece 13 by a predetermined distance. The threaded rod 33 is engaged with the threaded hole 25 of the fastening member 20. The shoulder 35 is provided in the outer periphery with grooves and ridges 37. The turning portion 31 is provided in the outer periphery with an actuation slot 39.

An upper 40 has a body 41 of a predetermined shape, and two connection portions 43 and 44, which are provided with a connection hole 45 for fitting with the fastening portion 23 of each fastening member 20 such that the upper is confined by the shoulder 35 of the stop member 30. The upper 40 is provided with a heel strap 80.

Figure 2:
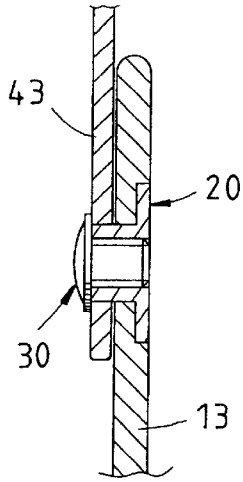
FIG. 2 shows a sectional view taken along a line 2—2 as shown in FIG. 1.
Figure 3:
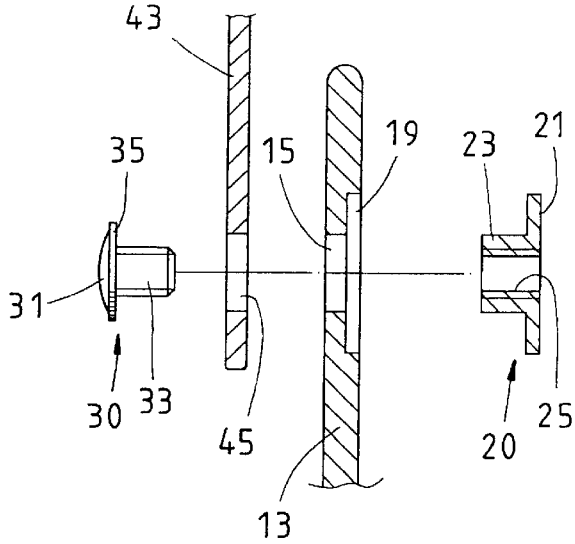
FIG. 3 shows an exploded view of FIG. 2.
Figure 4:
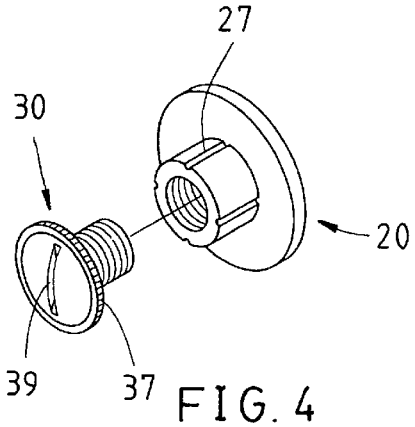
FIG. 4 shows an exploded view of fastening member and stop member of the preferred embodiment of the present invention.

As shown in FIGS. 2 and 3, the upper 40 is detachably fastened with the sole such that the fastening portion 23 of one of the fastening members 20 is put through the disposition hole 15 of each connection piece 13 of the sole 10. The fastening portion 23 of the fastening member 20 is jutted out by a predetermined length. The portion that is jutted out is fitted with the connection hole 45 of the connection portion 43 of the upper 40. In the meantime, the threaded rod 33 of the stop member 30 is engaged with the threaded hole 25 of the fastening member 20. The shoulder 35 prevents the upper 40 from falling out.

The upper can be detached by following the above-mentioned steps in reverse.

Figure 5:
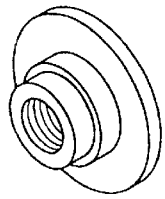
FIG. 5 is a schematic view of another fastening member of the preferred embodiment of the present invention to show that its fastening portion has two stepped structures different in diameter.
Figure 6:
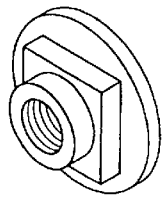
FIG. 6 is a schematic view of another fastening member of the preferred embodiment of the present invention to show that it has a square and a round rod diameter states.
Figure 7:
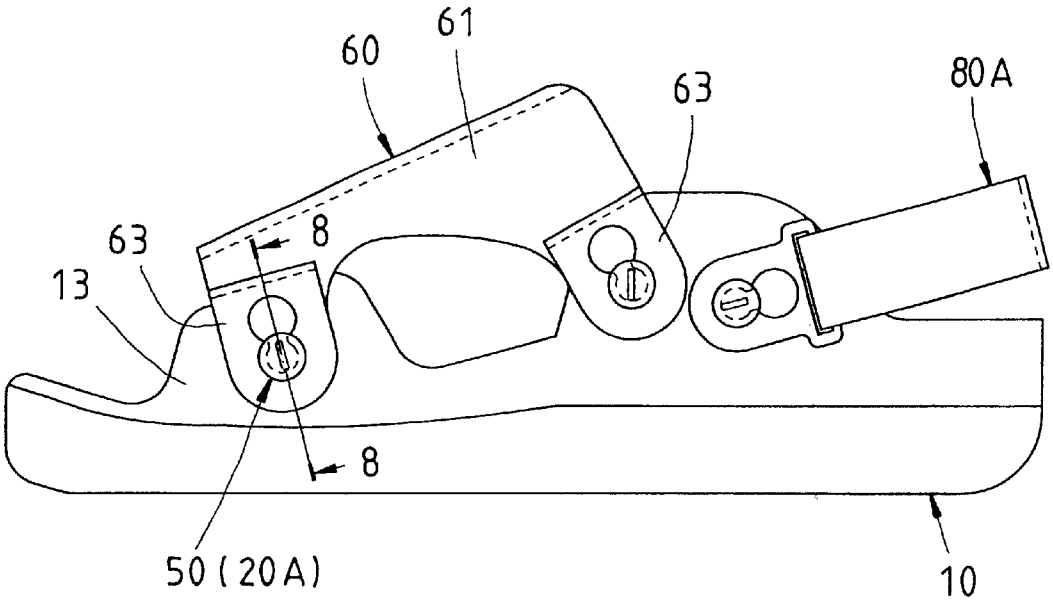
FIG. 7 is a side view of another preferred embodiment of the present invention to show the combination state of the upper and the heel strap.
Figure 8:
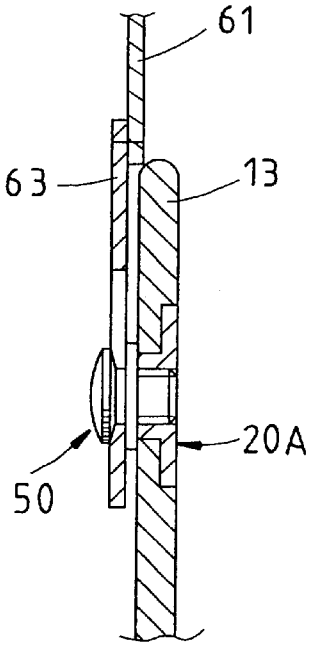
FIG. 8 shows a sectional view taken along a line 8—8 as shown in FIG. 7.
Figure 9:
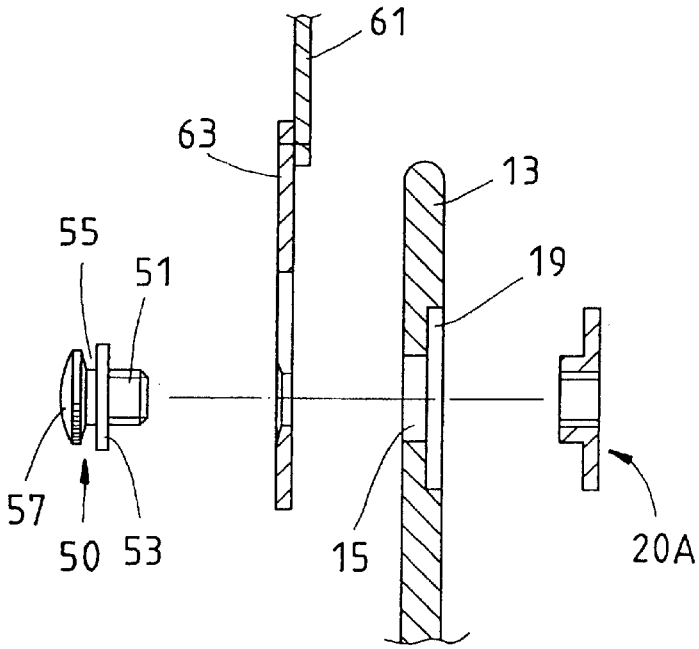
FIG. 9 shows an exploded view of FIG. 8.
Figure 10:
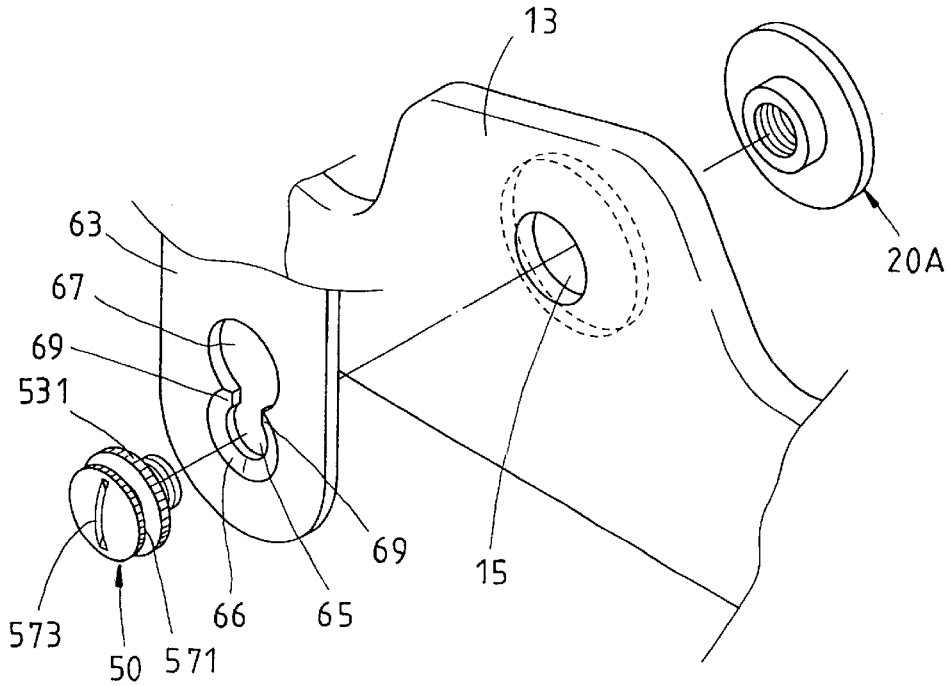
FIG. 10 shows an exploded view of another preferred embodiment of the present invention.

As shown in FIG. 5, the fastening portion of the fastening member of the preferred embodiment of the present invention is a two-stepped cylindrical pillar different in diameter to cooperate with the connection holes of the upper. As shown in FIG. 6, the fastening portion of the fastening member has a square shape, which is corresponding to the shape of the disposition hole of the sole.

As shown in FIGS. 7–10, a sandal of another preferred embodiment of the present invention comprises the following component parts.

A sole 10 is similar to that of the preceding embodiment.

A plurality of fastening members 20A are similar to those of the preceding embodiment.

A plurality of hooked members 50 have a threaded rod 51 engaged with the disposition holes 15 of the connection pieces 13 and 14 of the sole 10, a shoulder 53 attached to the connection holes 13 and 14, a neck 55, and a head 57. The shoulder 53 and the head 57 are provided respectively with grooves and ridges 531, 571. The head 57 is provided with an actuation slot 573.

An upper 60 has a body 61 which is connected in left and right sides with a connection piece 63 having a connection hole 65 for fixing the neck 55 of the hooked member 50, and having an appropriate tapered face 66. The connection piece 63 is further provided with a fitting hole 67 in communication with the connection hole 65. Located between the two holes 65,67 are two stop edges 69. The upper is provided with a heel strap 80A.

The sole and the upper are detachably fastened together by first engaging the hooked member 50 with the threaded hole 25 of the fastening member 20A, so as to enable them to be fixed with the connection piece 13 of the sole 10.

Figure 11:
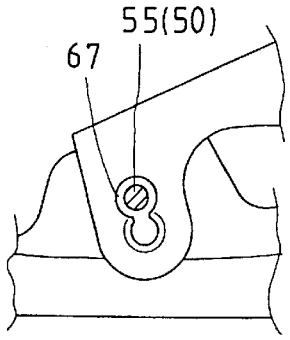
FIG. 11 is a front view of the preferred embodiment of the present invention to show its pre-engagement state.
Figure 12:
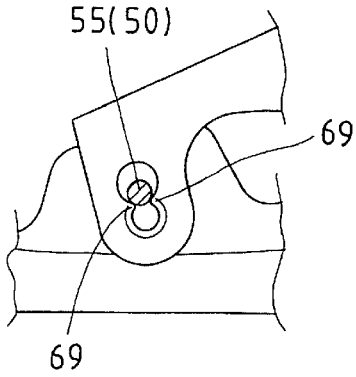
FIG. 12 is the same as the engagement state of FIG. 11.
Figure 13:
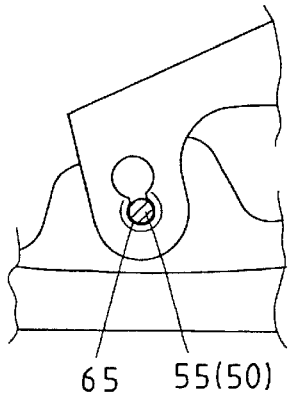
FIG. 13 is the same as the post-engagement state of FIG. 11.

As shown in FIG. 11, the head 57 of the hooked member 50 is completely fitted into the fitting hole 67 of the connection piece 63. The connection piece 63 is then pulled in reverse toward the connection hole 65. In the meantime, the neck 55 of the hooked member 50 is stopped by the stop edges 69 of two sides of the connection piece 63, as shown in FIG. 12. By means of a greater pull force, the connection hole 65 of the upper 60 can be fitted over the neck 55 of the hooked member 50, as shown in FIG. 13.

Figure 14:
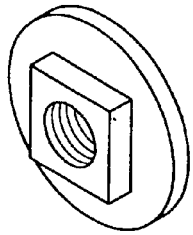
FIG. 14 is a schematic view of another fastening member of another preferred embodiment of the present invention to show the square state of its fastening portion.

As shown in FIG. 14, the fastening portion of the fastening member 20A has a square shape. The disposition hole of the sole also has a square shape.

The fastening members 20, 20A of the two preceding embodiments are not confined to the interchangeable combination and may be enclosed at the time when each connection piece of the upper is formed.

Figure 15:
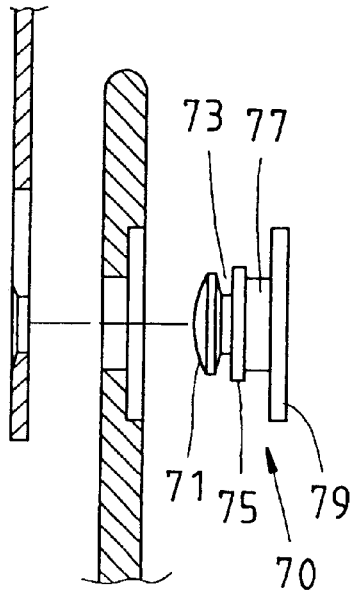
FIG. 15 is an exploded view of still another preferred embodiment of the present invention to show that its hooked member is integrally made.
Figure 16:
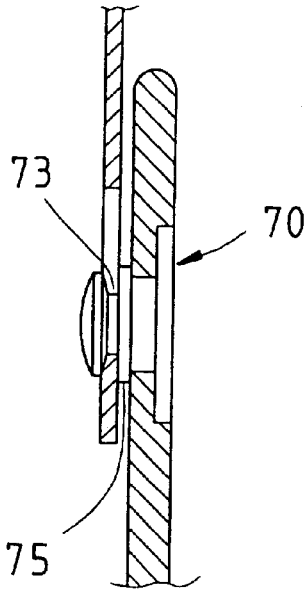
FIG. 16 shows a sectional view of still another preferred embodiment of the present invention in combination.

As shown in FIGS. 15 and 16, is a sandal of still another preferred embodiment of the present invention. The fastening member 20 and the hooked member 30 of the second preferred embodiment are made integrally to form a hooked member 70 which is formed of a head 71, a neck 73, a shoulder 75, a shank 77, and a stop tray 79. The shank 77 is fixed in the disposition hole of each connection piece of the sole. The neck 73 is caught in the connection hole of the upper.

Figure 17:
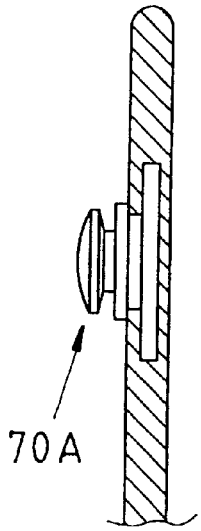
FIG. 17 is a schematic view of still another preferred embodiment of the present invention to show that the hooked member is enclosed by the sole.

As shown in FIG. 17, the hooked member 70A is formed together with the connection piece such that the hooked member 70A is enclosed by the connection piece.

Figure 18:
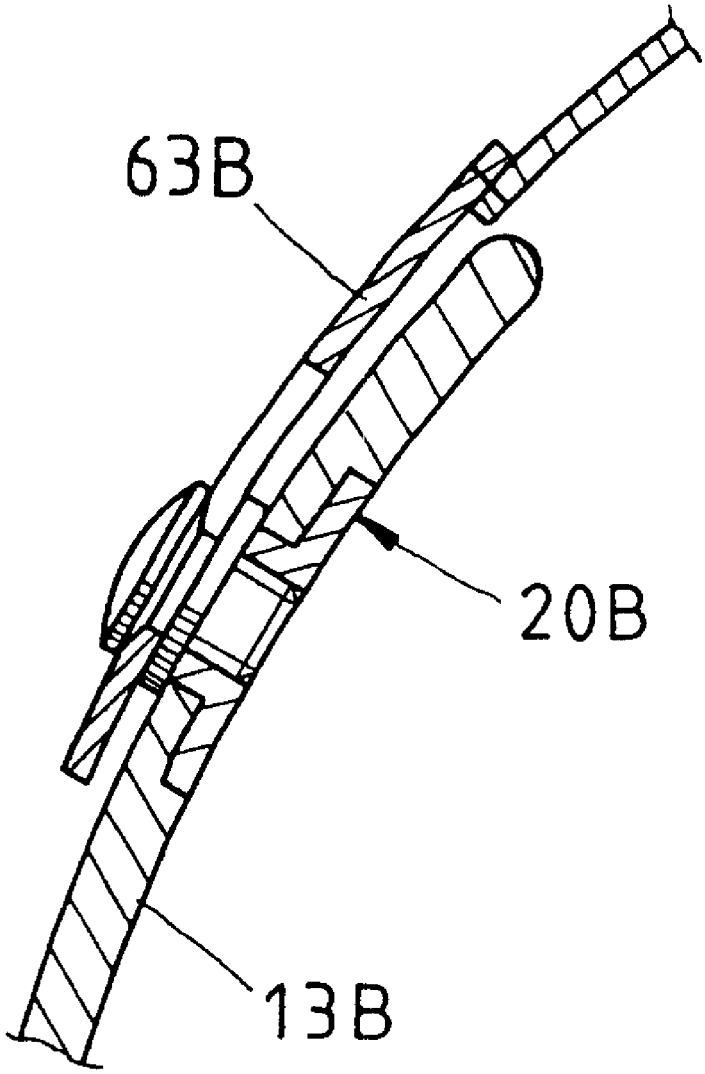
FIG. 18 is a sectional view of another preferred embodiment of the present invention to show that each connection piece of the sole has an arcuate shape.

The shapes of the preceding embodiments are expressed by straight lines. However, the shapes are various, depending on their locations, as shown in FIG. 18 in which the connection piece 13A of the sole and the connection piece 63B of the upper are arcuate to cooperate with the foot. The fastening member 20B may be also arcuate so as to be harmonious with the mechanics of human body.

The upper or the heel strap of the present invention are detachably fastened by this mode. In practice, this can be used alone with the upper or the heel strap, depending on the requirement. The upper or the heel strap is not confined to any specific structure or form.

The present invention has the following features. In the first place, the sole and the upper of the present invention can be easily replaced so as to make the product versatile. In addition, the upper and the sole are recyclable. Moreover, the sandal of the present invention is cost-effective.

What is claimed is:

1. A sandal comprising:

a sole provided in a side with a connection piece;

a fastening members fastened fixedly or movably with said connection piece of said sole and provided with a threaded hole extending from an outer end thereof;

a hooked member having a threaded rod which is engaged with said threaded hole of said fastening member and is provided at other end with a neck; and an upper provided in a side with a connection piece having a connection hole for fixing said neck of said hooked member, said connection piece of said upper provided with a fitting hole in communication with said connection hole, said fitting hole and a juncture of two sides of said connection hole provided with a stop edge for stopping said neck of said hooked member, said upper being connected at another end thereof with said sole, said connection piece further having a tapered faced formed at a periphery of the connection hole.

2. The sandal as defined in claim 1, wherein each of said connection pieces is provided with a disposition hole; wherein said fastening member is provided with a fastening portion which is fixed in said disposition hole.

3. The sandal as defined in claim 1, wherein said connection hole of said upper has a round cross section; wherein said neck of said hooked member has a round cross section.

4. The sandal as defined in claim 1, wherein said neck of said hooked member is provided in one side with a shoulder for separating said connection piece of said sole from said upper.

5. The sandal as defined in claim 1, wherein said upper is a heel strap.

6. The sandal as defined in claim 1, wherein said head of said hooked member is provided in an outer periphery with grooves and ridges to facilitate the turning of said hooked member with fingers.

7. The sandal as defined in claim 1, wherein said head of said stop member is provided in an outer end surface with an actuation slot to facilitate the turning of said stop member with a hand tool.

8. A sandal comprising:

a sole provided in a side with a connection piece;

a hooked member fastened fixedly or movably with said connection piece of said sole and provided with a neck;

an upper provided in a side with a connection piece having a connection hole for fixing said neck of said hooked members, said connection piece of said upper being further provided with a fitting hole in communication with said connection hole, said fitting hole and a juncture of two sides of said connection hole being provided with a stop edge for stopping said neck of said hooked members, said upper being connected at another end thereof with said sole, connection piece further having a tapered face formed at a periphery of the connection hole.

9. The sandal as defined in claim 8, wherein aid connection piece of said sole is provided with a disposition hole; wherein said hooked members have a fastening portion which is fixed in said disposition hole of said connection piece.

10. The sandal as defined in claim 8, wherein aid connection hole of said upper has a round cross section.

11. The sandal as defined in claim 8, wherein said neck of said hooked members is provided in one side with a shoulder for separating said connection piece of said sole from said upper.

12. The sandal as defined in claim 8, wherein said upper is a heel strap.

* * * * *